US007334433B1

(12) United States Patent
Fuhrman et al.

(10) Patent No.: US 7,334,433 B1
(45) Date of Patent: Feb. 26, 2008

(54) MAGNETIC JEWELRY CLASP

(76) Inventors: Esther C. Fuhrman, 600 Harbor Blvd., Suite 1022, Weehawken, NJ (US) 07086; Robert J. Fuhrman, 600 Harbor Blvd., Suite 1022, Weehawken, NJ (US) 07086

( * ) Notice: Subject to any disclaimer, the term of this patent is extended or adjusted under 35 U.S.C. 154(b) by 0 days.

(21) Appl. No.: 10/779,433

(22) Filed: Feb. 13, 2004

Related U.S. Application Data

(60) Provisional application No. 60/448,027, filed on Feb. 18, 2003.

(51) Int. Cl.
*A44C 17/02* (2006.01)
*A44C 5/00* (2006.01)

(52) U.S. Cl. ..... 63/3.1; 63/900; 63/29.2; 63/3; 24/303

(58) Field of Classification Search ..... 24/303; 63/3.1, 29.2, 900
See application file for complete search history.

(56) References Cited

U.S. PATENT DOCUMENTS

| | | | | |
|---|---|---|---|---|
| 468,677 | A * | 2/1892 | Maxheimer et al. | 24/616 |
| 1,441,999 | A | 1/1923 | Posner | |
| 1,807,293 | A * | 5/1931 | Keller | 24/616 |
| 2,178,572 | A * | 11/1939 | Forstner | 24/616 |
| 4,530,221 | A * | 7/1985 | Weinberg | 63/3.2 |
| 5,008,984 | A * | 4/1991 | Levy | 24/303 |
| 5,050,276 | A * | 9/1991 | Pemberton | 24/303 |
| 5,197,168 | A * | 3/1993 | Levy | 24/303 |
| 5,311,647 | A * | 5/1994 | Levy | 24/303 |
| 5,317,789 | A * | 6/1994 | Levy | 24/303 |
| 5,349,725 | A * | 9/1994 | Levy | 24/303 |
| 5,367,891 | A | 11/1994 | Furuyama | |
| 5,664,298 | A | 9/1997 | Nessar-Ivanovic | |
| 6,591,462 | B2 * | 7/2003 | Fuhrman | 24/303 |
| 6,640,398 | B2 * | 11/2003 | Hoffman | 24/303 |
| 7,073,232 | B1 * | 7/2006 | Fuhrman et al. | 24/303 |

FOREIGN PATENT DOCUMENTS

| | | | |
|---|---|---|---|
| EP | 462072 | A1 | 12/1991 |

* cited by examiner

*Primary Examiner*—J. J. Swann
*Assistant Examiner*—David Reese
(74) *Attorney, Agent, or Firm*—Feldman Law Group

(57) ABSTRACT

A jewelry clasp having a pair of housings at the free ends of a piece of jewelry and are affixed together by magnetic forces. Each housing has a permanent magnet located therein and which magnets are attracted to each other when the housings are brought together. There is a safety catch on one of the housings having a protuberance extending therefrom that enters a slot in the other body. The slot passes entirely through the housing so that the protuberance can enter the slot in a first orientation and in a second orientation where one housing is inverted 180 degrees from the first orientation. The safety catch also includes a nib that aligns with an indentation formed in the slot and the entering of the nib into the indentation can be felt and/or heard by the wearer to provide assurance that the safety catch is in its locked position.

17 Claims, 5 Drawing Sheets

MAGNETIC JEWELRY CLASP

REFERENCE TO RELATED CASES

The present application is based upon and hereby claims priority to U.S. Provisional Application Ser. No. 60/448,027 filed Feb. 18, 2003 and entitled MAGNETIC JEWELRY CLASP.

BACKGROUND OF THE INVENTION

The present invention relates to jewelry and, more particularly, to an improved clasp for joining the two free ends of a jewelry chain together easily to facilitate that junction.

With certain jewelry, particularly women's jewelry, there is an inherent conflict between the need to make the clasp easy to facilitate so that the wearer can readily join the free ends of the bracelet or necklace, and the need to make the clasp very secure so that it does not easily and inadvertently become unattached and risk the potential loss of the jewelry.

Thus, even young people, having a great deal of dexterity, find it difficult to fasten necklaces behind their necks or fasten most bracelets which, by their nature, must be fastened with the use of only one hand. This problem is compounded many fold in the case of older people or the many millions of people who suffer from even mild cases of arthritis or similar afflictions that limit the use of the hands.

Magnetic clasps are widely used for costume jewelry. However, manufacturers and retailers of fine jewelry (gold jewelry, sterling silver jewelry or jewelry containing gemstones) offer necklaces with magnetic clasps less frequently. Makers and wearers of fine jewelry want the security of a safety catch and many of the available magnetic clasps with safety catches are not considered practical. Such clasps are either too difficult to close, not secure when closed or are too difficult to open. In addition some are simply not attractive.

Accordingly, the clasps for jewelry, as well as clasps for other items, have a long felt need to meet all three of the key consumer requirements, that is, the clasp must be easy to close, it must be secure when closed i.e. it must have a safety catch, and it must be easy for the wearer to open. In addition to those functional requirements, of course, the clasp is commercially benefited by being attractive so that the clasp enhances, rather than detracts, from the overall attractive appearance of the jewelry itself. It is also desirable for a clasp design to be made in narrow and wide versions and in various sizes so as to tie in with and look attractive with different sizes and styles of necklaces and bracelets.

One of the difficulties with the use of a safety catch on a magnetic clasp is the need to align the two ends to be joined together by means of the magnetic attraction requires that the components of the clasp be brought together in a very specific orientation with respect to each other, that is, the components of the clasp must be joined together in only one, specific orientation. Obviously, this is a detraction from the versatility of the magnetic clasp itself, since the need to orient each of the components in a specific manner makes it difficult to bring the clasp together and defeats the purpose of the magnetic clasp that is intended to make the joining of the clasp easy for the user.

An example of a magnetic clasp that does not appear to require a specific orientation of the components of the clasp, and yet which does have a safety catch is shown and described in Levy, U.S. Pat. No. 5,008,984, however, while the components of Levy can be mated in various orientations with respect to each other, the safety catch of the Levy patent extends over the outside end surface of one of the clasp components and thus is susceptible to catching or snagging on the clothing of the wearer and thereby likely to detach the safety catch and thwart its purpose. As the aforementioned Levy clasp is round, it would also not be suitable for a wide necklace or bracelet, as making it sufficiently wide for a necklace of ¾ of a inch to 1½ inch wide or more would make the clasp too bulky.

It would, therefore, be advantageous for a magnetic clasp to have a safety catch mounted to one component of the clasp and to be movable to engage the other component in a manner that maintains a streamlined profile of the completed catch so that the safety catch is unlikely to be detached by snagging on the clothing of the wearer while, at the same time, allowing the separate clasp components to be magnetically affixed together in more than one orientation, and particularly at differing orientations that are 180 degrees apart.

It would, therefore, also be advantageous for a clasp to have all of the foregoing attributes and, additionally, provide some positive indication to the wearer that the clasp has been effectively and fully closed and one means of providing such a positive indication would be to have a positive clicking action that the wearer could hear and/or feel to indicate to the wearer that the clasp has been fully closed and the danger of a partially closed clasp inadvertently coming apart is basically eliminated. As such, the presence of a position click to enable the wearer to feel and/or hear the click provides an important level of comfort to the wearer that the clasp of the particularly piece of jewelry has been safely affixed together and that the jewelry is protected from an inadvertent and unwanted opening.

Accordingly, it would be advantageous to have a clasp for joining the free ends of a piece of jewelry having features that overcome the aforedescribed shortcomings in present clasps while having the desired functional features and, at the same time, providing an attractive appearance to the wearer.

SUMMARY OF THE INVENTION

The present invention relates to an improved clasp for jewelry, as well as other items, that is easy to close and where that closure is secure to protect the item of jewelry and wherein the clasp is also easy for the wearer to open.

In the present clasp, there are two housings that are affixed to the free ends of a necklace or bracelet and which are joined together to make up the clasp of the present invention. Each of the housings has positioned therein, magnetic means in the form of permanent magnets forming a magnetically attractive surface that is directed perpendicular to the front face of the permanent magnets. In carrying out the affixation of the housings, the magnetically attractive surfaces are located abutting each other such that the housings are forcefully held together by the mutual magnetic attraction of the magnetic poles of the respective permanent magnets aligning the housings against each other.

With the present invention, the permanent magnets are located within the housings and the housings are joined together so that the respective permanent magnets each have a outer surface that can contact each other so that the magnetic attraction can retain the two housings together.

As a feature of the present invention, the two housings can be brought together to achieve the magnetically attractive coupling in more than one specific orientation of the housings, that is, the housings can be brought together to affix the housings together in one orientation and, as an alternative orientation, one of the housings can be inverted 180 degrees and still be able to join together with the other housing in carrying out the completion of the coupling together of the clasp.

There is also a safety catch that is mounted to one of the housings and which can be pivotally affixed thereto and which can be moved between an open position and a locked position where the free end of the safety catch interfits with the other housing, thereby providing a safety catch to prevent the housings from coming apart.

In an embodiment, the safety catch has a protuberance that extends outwardly from the main body of the safety catch and which enters a slot formed in the other housing to latch the two housings firmly together. The slot is formed such that it opens on opposite external surfaces of the housing such that the protuberance on the safety catch can enter into the slot through either of the two opposed surfaces. As such, the two housings can be brought together to a position where the respective permanent magnets attract each other to hold the housings together and the safety catch can enter into the slot of the housing in two directions so that either of the housings can be inverted 180 degrees and still be interfitted together with the protuberance of the safety catch able to enter the slot in either of the two orientations.

There is an outwardly protruding nib formed on the outer surface of the protuberance at the free end of the safety catch and there is a indentation located on the inwardly facing surface of the slot, that is, the surface of the slot the faces the outer surface of the protuberance having the nib formed therein. Preferable, the indentation is located equidistant between the opposite external surfaces and the nib snaps into the indentation with a positive snap action to inform the wearer that the safety catch has been effectively engaged. With the indentation located in the particular location equidistant between the opposite external surfaces of the housing, the nib will be aligned with the indentation if inserted into the slot from either of the two directions such that the housings can be effectively brought together at one orientation and at another orientation 180 degrees inverted from the one orientation and yet the safety catch will be effective with a positive clicking action if inserted from either orientation.

When the safety catch is inserted into the slot, in either of the two directions, the end of the protuberance remains contained within the slot, or may extend slightly therefrom, so that the free end of the safety catch is protected from being snagged or caught on the clothing of the wearer. In the latter embodiment, the safety catch can be moved by the user away from its locked position by pushing on the free end of the safety catch.

These and other features and advantages of the present invention will become more readily apparent during the following detailed description taken in conjunction with the drawings herein.

DETAILED DESCRIPTION OF THE INVENTION

Figure 1:
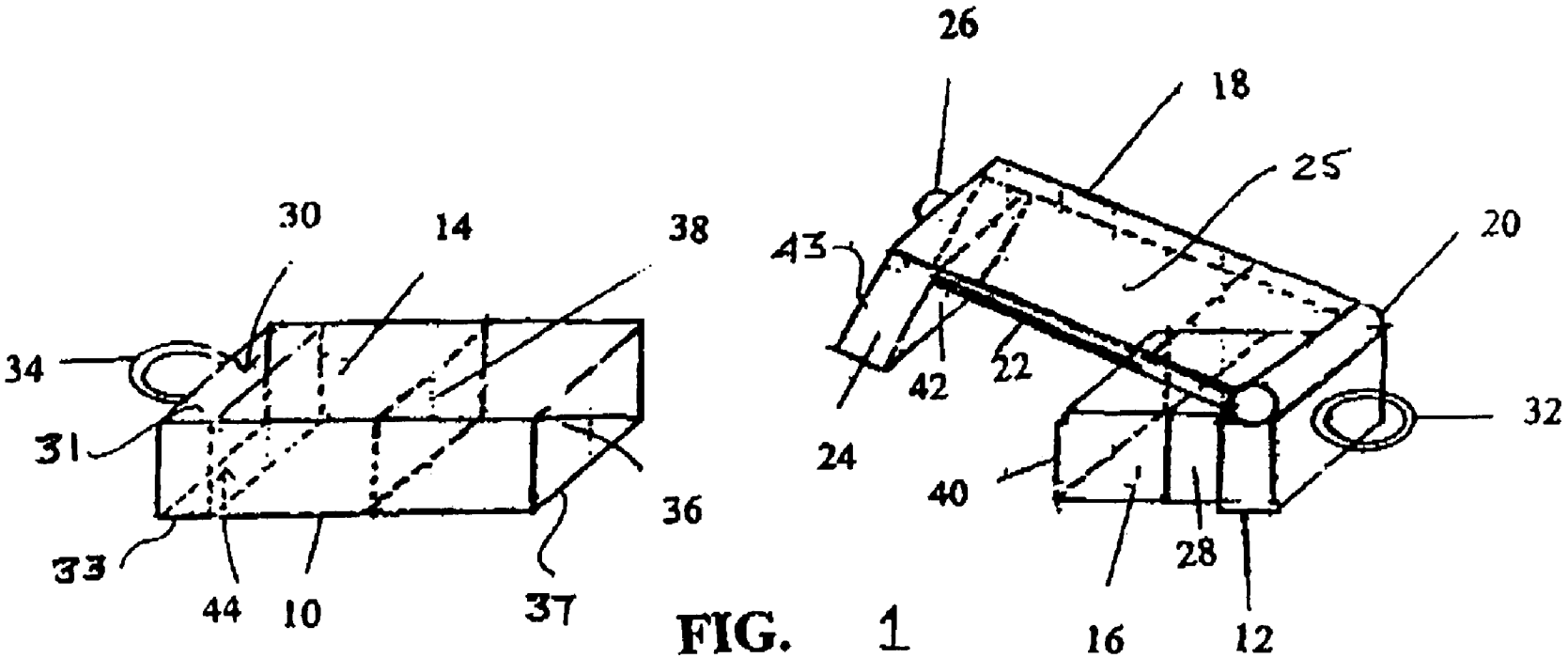
FIG. 1 is an exploded view of the two housings that make up the jewelry clasp of the present invention.

Referring now to FIG. 1, there is shown an exploded view of a magnetic jewelry clasp that is comprised of two housings 10, 12 that are adapted to be joined together to make up the jewelry clasp of the present invention. The housings 10, 12 can be made of many materials, preferable of the metal material, such as silver or gold that is the same as the material used in the piece of jewelry on which the clasp is being used.

As also can be seen, there is a magnetic means embedded or affixed within each of the housings 10, 12 and the magnetic means comprises permanent magnets 14, 16. The permanent magnets 14, 16 are arranged, spaced apart along a longitudinal line extending between the magnets and the polarity of each of the permanent magnets 14, 16 is predetermined as will also be explained.

There is also a safety catch 18 that is pivotally affixed to the housing 12 by means of a hinge 20 so that the safety catch 18 is free to pivot about the hinge 20 between an open position where the housings 10, 12 can be moved apart and a locked position where the housings 10, 12 are firmly affixed together. On the underside of the safety catch 18, in one of the embodiments, there is located a flat magnet or material or surface comprised of a magnetically attractable material, such as a steel plate 22.

The safety catch 18 has a protuberance 24 extending outwardly from the free end of the safety catch 18, preferably at about a right angle with respect to the main member 25 of the safety catch 18. At the upper edge of the protuberance 24, in one embodiment, there is small bead 26 to enable the wearer to place a fingernail under the safety catch 18 to move the safety catch 18 from its locked position to its open position as will later become clear. With the housing 12, there is a casing 28 that retains the permanent magnet 16 therein and that permanent magnet 16 may be secured within the casing 28 of housing 12 by an adhesive or other means.

A slot 30 is formed in the housing 10 and, as can be seen, the slot 30 passes entirely through the housing 10, that is, it extends between the upper external surface 31 and oppositely disposed lower external surface 33 of the housing 10 so that the slot 30 is accessible through either of the oppositely located external surfaces 31, 33. Additionally, as a feature, there is a pair of loops 32, 34 affixed to the housings 12, 10 to allow the housings 12, 10 to be affixed to the particular jewelry strand, such as a necklace or bracelet.

Thus, in the construction of the present jewelry clasp, there is formed in the housing 10, an opening 36 since the permanent magnet 14 is set into the housing 10 with a forward edge 37 that extends beyond the front surface 38 of the permanent magnet 14. The permanent magnet 16 in housing 12 also has a front surface 40 that faces outwardly from the casing 28.

The line of greatest magnetic attraction between permanent magnets 14 and 16 is perpendicular to the front surfaces 38, 40 so that the permanent magnets 14, 16 will come together and be attracted to each other and will automatically come together when the two housings 10, 12 are merely brought close to each other as will later be appreciated. There is also shown, an inner surface 42 of the protuberance 24, that is, the surface of the protuberance 24 that faces the permanent magnet 14 when the clasp of the present invention is closed and there may be a steel plate, (not shown) located along that inner surface 42 as an alternate location or additional location to the location of the magnet or steel plate 22 on the underside of the main member 25 of the safety catch 18. There is also shown an outer surface 43 of the protuberance 24.

Figure 2:
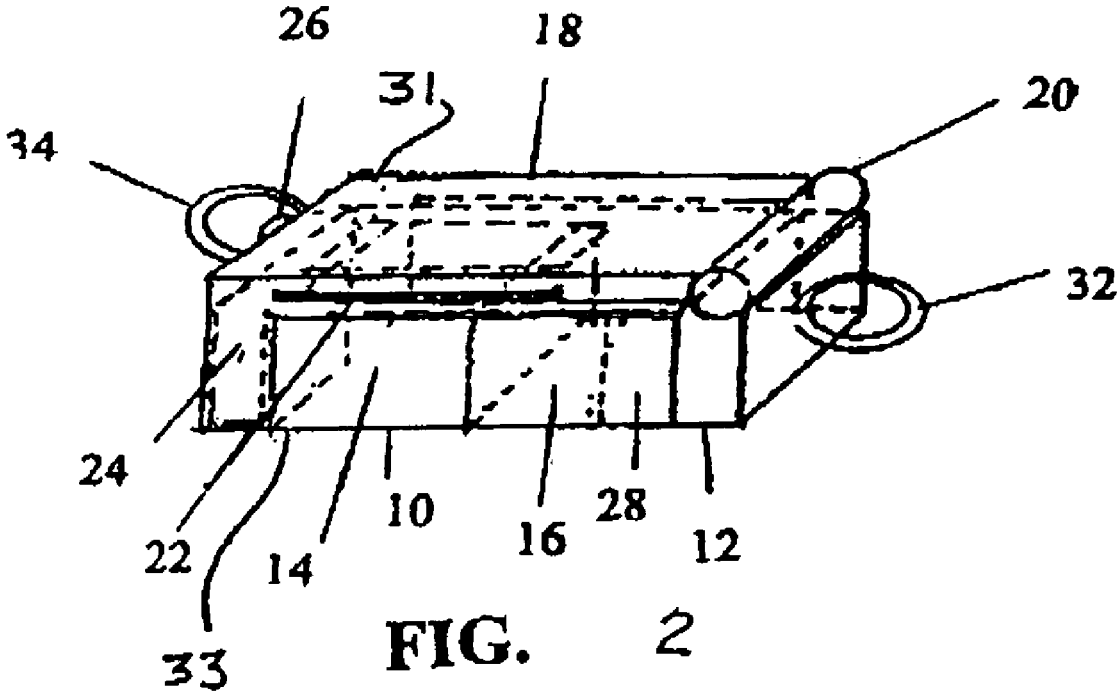
FIG. 2 is a perspective view of the completed clasp of the present invention shown in the closed position.

Turning now to FIG. 2, there is shown a perspective view of the completed jewelry clasp of the present invention with the housings 10, 12 affixed together and with the safety catch 18 in its locked position. In this closed position, the permanent magnet 16 that extends from the casing 28 enters into the opening 36 of housing 10 in order to properly locate the permanent magnets 14, 16 as well as to provide a good appearance to the overall completed clasp. As such, the front surface 40 of the permanent magnet 12 is in direct contact with and thereby abuts against the front surface 38 of the permanent magnet 14 such that the magnetic attraction therebetween holds the housings 10, 12 firmly together and yet it is relatively easy for the wearer to make that junction. Again, due to the orientation of the magnetic attraction of the permanent magnets 14, 16 that extends outwardly perpendicularly from the front faces 38, 40 of the permanent magnets 14, 16, those permanent magnets 14, 16 attract each other and retain the housings 10, 12 together.

As also can be seen in FIG. 2, the steel plate 22 (or magnet) located at the underside of the main member 25 of the safety catch 18 is located within the magnetic attraction of the permanent magnet 14 so that such magnetic attraction aids in retaining the safety catch 18 in its locked position. The safety catch 18 can be seen to be in its locked position with the protuberance 24 inserted into and therefore positioned within the slot 30 to retain the housings 10, 12 together.

Figure 5:
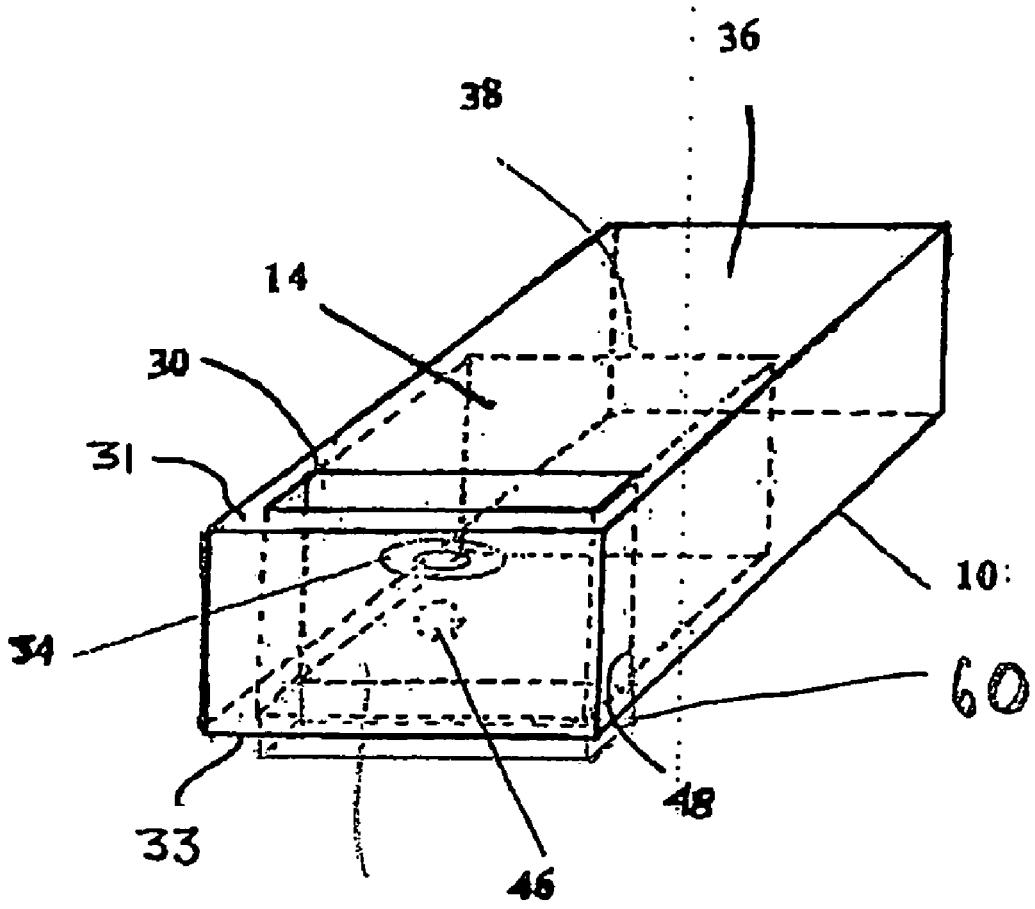
FIG. 5 is a perspective view of the other housing of the present invention.

As an alternative embodiment, see FIG. 5, the protuberance 24 can extend through and actually have its free end extend beyond the depth of the slot 30, that is, the protuberance 24 can enter through one of the external surfaces of the second housing and pass through the slot 30 to emerge outwardly through the other external surface. In such embodiment, it would be possible to eliminate the small bead 26 and simply open the safety catch 18 by pushing inwardly on the protruding free end 60 of the protuberance 24.

This feature makes it possible to make the visible surface of the clasp, away from the neck (in the case of a necklace) or away from the wrist (in the case of a bracelet) smooth, attractive and very secure i.e. much more secure that the clasp in the aforementioned Levy U.S. Pat. No. 5,008,984 and other prior designs. The visible surface can be free of any nib, slot or anything else that could become caught on something or enable a potential thief to easily open the necklace or bracelet. Yet the wearer can easily open the clasp by putting her or his finger between the clasp and the wrist (in the case of a bracelet) of the clasp and the neck (in the case of a necklace). This will automatically push the protuberance 24 way out of the slot 30 and make it easy to open completely. Once the safety catch is disengaged, the two housings 10, 12 of the necklace can be easily pulled apart.

Figure 3:
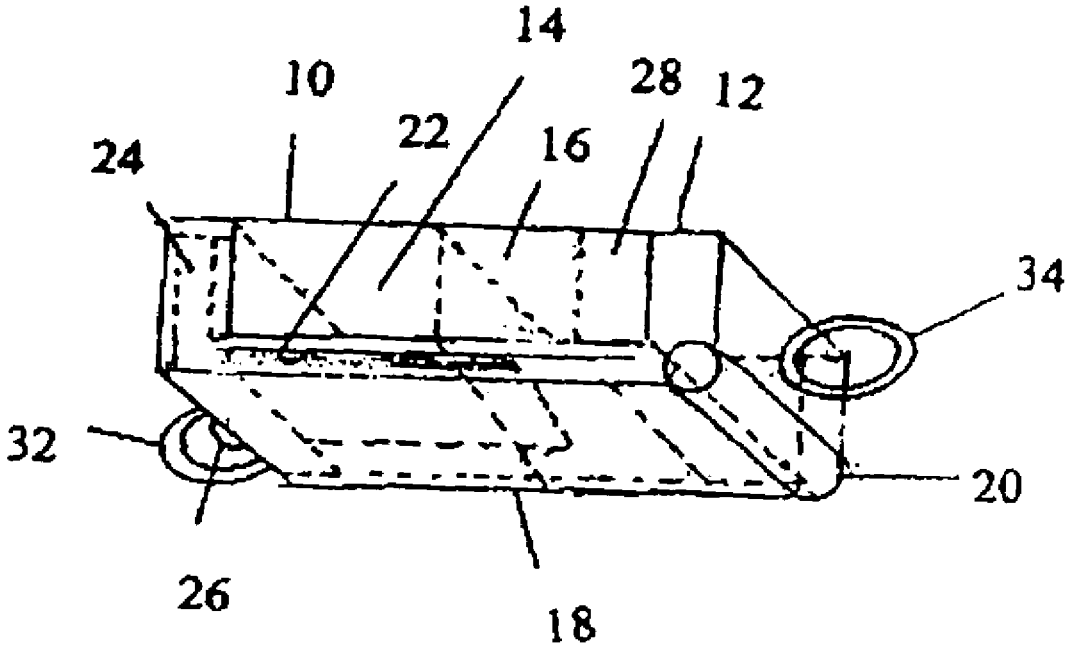
FIG. 3 is a perspective view of the completed clasp of FIG. 2 in the closed position with one of the housings inverted.

Turning now to FIG. 3, there is a perspective view of the jewelry clasp of the present invention with the housing 12 inverted 180 degrees with respect to the housing 10. In FIG. 3, it can be seen that despite the inverting of the housing 12, the safety catch 18 can still function in the same manner as in FIG. 2 since, as explained, the slot 30 extends fully through the housing 10, that is, between the oppositely disposed external surfaces 31, 33 of the housing 10.

Accordingly even when one of the housings is inverted 180 degrees, the jewelry clasp still functions in its normal manner with the joining the two housings 10, 12 by the magnetic attraction between the permanent magnets 14, 16 with their front surfaces 38, 40 abutting each other and with the safety catch 18 retained within the slot 30 where the lower edge of the protuberance 24 is protected from being snagged or caught by the clothing where such snagging or catching can inadvertently move the safety catch 18 from its locked to its open positions.

Figure 4:
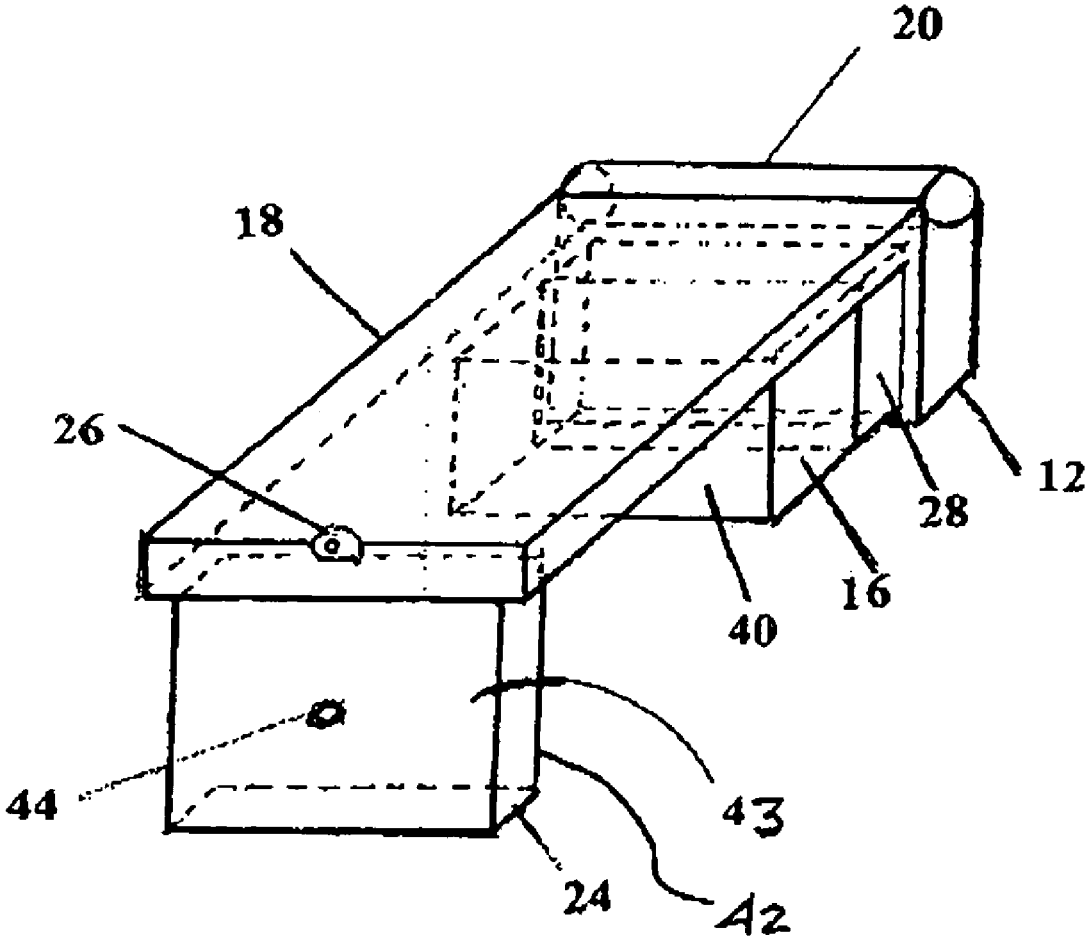
FIG. 4 is a perspective view of one of the housings.

Turning now to FIG. 4, there is a perspective view of housing 12 and illustrating a further feature of the present invention where there is provided a positive clicking action when the safety catch 18 is moved into its locked position so as to enable the wearer to be assured that the safety catch 18 is, in fact, in its locked position such that the jewelry clasp is safely secured and the jewelry protected against inadvertently opening and falling off of the wearer.

Accordingly, in FIG. 4, there is a nib 44 formed on the outer surface 43 of the protuberance 24 of the safety catch 18 and that nib 44 extends outwardly therefrom. In the embodiment shown, the location of the nib 44 is at the center of the protuberance 24 to enable the snap acting and sounding feature to be effective whether the housings 10, 12 are in the orientation of FIG. 2 of the inverted orientation of FIG. 3.

Turning to FIG. 5, taken along with FIG. 4, there is a perspective view of the housing 10 and further illustrating the positive clicking feature of FIG. 4. In FIG. 5, however, there is an indentation 46 formed on the inward, internal surface of the slot 30 such that, when the safety catch 18 is moved to its locked position, the nib 44 snaps into the indentation 46 with a clicking sound that, as described, lets the wearer know that the safety catch 18 has been properly seated and is in its locked and safe position. The indentation 46 can be constructed of spring steel material so as to enhance the snapping action and the sound and feel that is produced as the nib 44 is snapped into the indentation 46.

Again, the preferred location of the indentation 46 is equidistant between the opposite upper and lower external surfaces 31, 33 of the housing 10 so that the safety catch 18 and the clicking, positive feel and sound of the nib 44 snapping into the indentation 46 can be effective when the housings 10, 12 are either in the normal or inverted orientations of FIGS. 2 and 3.

Accordingly, in either of the orientations of FIG. 2 or FIG. 3, the sound or feeling of the snap of the nib 44 into the indentation 46 is a good, reassuring indication to the wearer that the clasp has been fully joined together and that the safety catch 18 is properly positioned in its locked position so that the wearer can be assured that the clasp is solidly affixed together and there is little danger of it being inadvertently separated with a potential loss of the jewelry.

Those skilled in the art will readily recognize numerous adaptations and modifications which can be made to the jewelry clasp and method of joining the same of the present invention which will result in an improved process and clasp, yet all of which will fall within the scope and spirit of the present invention as defined in the following claims. Accordingly, the invention is to be limited only by the following claims and their equivalents.

We claim:

1. A jewelry clasp comprising, a first housing, the first housing including a distal end and a proximal end, the proximal end containing a permanent magnet having a facing surface, and the distal end including a safety catch, a second housing, the second housing having a first and second external surfaces, the second housing further including an opening located on a front section of said second housing, a permanent magnet having a facing surface located on a middle section of said second housing, and a slot located on a rear section of said second housing, said permanent magnets both being magnetized so that the line of greatest magnetic force is perpendicular to the facing surfaces, said facing surfaces of the permanent magnets attracted to each other when positioned proximate to each other and within the field of the magnetic forces, whereby said safety catch has one end pivotally mounted to the distal end of the first housing and has a protuberance extending outwardly from the other end, the protuberance having a free end, said slot of said second housing passes fully through the second housing to be accessible through both said first and said second external surfaces, and said safety catch is rotatable about the pivotal mounting to a locked position wherein the free end of the protuberance enters the slot through either the first or second external surfaces of the second housing to retain the first and second housings together.

2. The jewelry clasp of claim 1 wherein the first housing has an opening and the permanent magnet in the second housing fits into the opening in the first housing to place the permanent magnets in close proximity to each other to magnetically attract each other.

3. The jewelry clasp of claim 1 wherein the safety catch has a straight member pivotally mounted to the first housing and the protuberance extends from the free end thereof at an angle of about 90 degrees.

4. The jewelry clasp of claim 1 wherein the slot has an outer surface having at least one indentation and said protuberance has at least one protruding nib that snaps into the at least one indentation when said safety catch is in said locked position to hold the first and second housings together.

5. The jewelry clasp of claim 1 wherein said at least one indentation is located about equidistant between each of the first and second external surfaces of the second housing.

6. The jewelry clasp of claim 5 wherein the indentation is formed in a spring steel material.

7. The jewelry clasp of claim 1 wherein the safety catch has a magnetically attractable material or magnet that is attracted to the permanent magnet located in the second housing.

8. The jewelry clasp of claim 7 wherein the magnetically attractable material comprises a magnet or steel plate affixed along an internal surface of said safety catch.

9. The jewelry clasp of claim 1 wherein the free end of the protuberance extends beyond the depth of the slot thereby allowing the free end of the protuberance to protrude from the jewelry clasp.

10. A method of completing the connection of a jewelry clasp said methods comprising the steps of:

providing a first housing having a jewelry chain affixed thereto and having a magnetic surface and a safety catch, providing a second housing having a jewelry chain affixed thereto, a pair of oppositely disposed external surfaces and having a magnetic surface, a slot and an opening;

joining the first and second housings together by aligning and facing the magnetic surfaces facing each other;

providing the safety catch to be movably affixed to the first housing and adapted to be movable to a locked position, said safety catch having a free end;

providing the slot in the second housing to extend entirely through the second housing and opening through both of said oppositely disposed external surfaces;

engaging the first and second housings together to align the magnetic surface of the first housing with the magnetic surface of the second housing abutted together to complete the connection of the first and second housings together; and moving the safety catch to the locked position wherein the free end of the safety catch enters into the slot through the opening in either of the oppositely disposed external surface.

11. The method as defined in claim 10 wherein the step of providing a first housing and the step of providing a second housing comprises providing a first housing and a second housing having permanent magnets disposed therein forming the magnetic surfaces.

12. The method as defined in claim 10 wherein the step of providing a safety catch comprises providing a safety catch having a nib extending outwardly therefrom and said step of providing a slot comprises providing a slot having an indentation formed therein and said step of moving the safety catch to a locked position comprises engaging the nib within the indentation.

13. The method as defined in claim 10 wherein the step of providing a safety catch comprises providing a safety catch having a magnet or magnetically attractable material that is attracted to the permanent magnet located in the second housing.

14. The method as defined in claim 13 wherein the step of providing a safety catch comprises providing a safety catch having a nib extending outwardly therefrom and said step of moving the safety catch to a locked position comprises moving the safety catch to a position where the magnetically attractable material is attracted to the permanent magnet in said second housing.

15. The method as defined in claim 13 wherein the step of providing a safety catch comprises providing a safety catch having a magnetically attractable material located on a surface that overlies one of the oppositely disposed external surfaces of the second housing.

16. The method as defined in claim 13 wherein the step of providing a safety catch comprises providing a safety catch having the magnet or magnetically attractable material located on a surface that abuts against an internal surface of the slot formed in the second housing.

17. The method as defined in claim 10 wherein the step of moving the catch to the locked position allows the free end of the protuberance to extend beyond the depth of the slot thereby allowing the free end of the protuberance to protrude from the jewelry clasp.

* * * * *